US009640153B2

(12) United States Patent
Wiley et al.

(10) Patent No.: US 9,640,153 B2
(45) Date of Patent: May 2, 2017

(54) ACOUSTIC DECOUPLING DEVICE

(71) Applicants: Richard Wiley, El Cajon, CA (US); Toby L. Ahrens, San Diego, CA (US)

(72) Inventors: Richard Wiley, El Cajon, CA (US); Toby L. Ahrens, San Diego, CA (US)

( * ) Notice: Subject to any disclaimer, the term of this patent is extended or adjusted under 35 U.S.C. 154(b) by 0 days.

(21) Appl. No.: 14/635,959

(22) Filed: Mar. 2, 2015

(65) Prior Publication Data

US 2015/0170623 A1 Jun. 18, 2015

Related U.S. Application Data

(63) Continuation-in-part of application No. 13/939,122, filed on Jul. 10, 2013, now Pat. No. 8,969,696.

(60) Provisional application No. 61/678,280, filed on Aug. 1, 2012.

(51) Int. Cl.
*G10D 13/02* (2006.01)

(52) U.S. Cl.
CPC ..... *G10D 13/026* (2013.01)

(58) Field of Classification Search
CPC ..... G10D 13/026
USPC ..... 84/421, 411 P, 422.1
See application file for complete search history.

(56) References Cited

U.S. PATENT DOCUMENTS

| | | | | |
|---|---|---|---|---|
| 7,365,257 | B2 * | 4/2008 | Sato | F16M 11/20 84/421 |
| 7,468,480 | B1 * | 12/2008 | Sikra | G10D 13/026 84/421 |
| 2007/0199429 | A1 * | 8/2007 | Hsieh | G10D 13/026 84/422.1 |
| 2010/0313735 | A1 * | 12/2010 | Steinhauser | G10D 13/026 84/421 |
| 2014/0026736 | A1 * | 1/2014 | Sato | G10D 13/026 84/421 |

* cited by examiner

*Primary Examiner* — Jianchun Qin
(74) *Attorney, Agent, or Firm* — Donn K. Harms

(57) ABSTRACT

A drum-supporting component is provided for maintaining a drum or cymbal acoustically separated from an underlying support surface. A body of the component is configured to maintain the drum separated from the underlying support thereby increasing the sound generated from the drum which is projected therefrom.

12 Claims, 6 Drawing Sheets

ACOUSTIC DECOUPLING DEVICE

This application is a continuation in part application to U.S. patent application Ser. No. 13/939,122 filed on Jul. 10, 2013, which claims priority to U.S. Provisional Patent Application Ser. No. 61/678,280 filed on Aug. 1, 2012, both of which are herein incorporated in their entirety by this reference thereto.

BACKGROUND OF THE INVENTION

1. Field of the Invention

The present invention relates to percussion style musical instruments. More specifically, the device relates to drum sets and improved supports or feet configured for engagement with such drum set components upon support legs, which act to enhance sound emitted therefrom. In some preferred mode the device additionally employs means for reflecting the acoustic vibratory energy back into the drum or cymbal to thereby reduce energy loss and enhance the musical sound emitted from the drum or cymbal.

2. Prior Art

A drum kit, also referred to as a drum set, is a collection of drums and cymbals as well as other percussion instruments including cowbells, chimes, etc. A conventional drum kit typically consists of a ride cymbal, a floor tom, high toms, bass drum, snare drum, a hi hat, and often additional cymbals.

Typically, the drum kit has been an instrument that does not always require electronic amplification as the drummer can produce louder, fuller, and deeper sounds simply by striking the drums heads with more power and energy. When the user strikes the drum head or cymbal, the vibrating head or cymbal causes sound waves to resinate producing the drum sounds we typically hear.

Unlike a guitar or other user supported instruments, many of the components of a drum kit are supported on a supporting surface such as the floor of the playing venue, through rigid support legs. These legs either extend from brackets engaged directly on the drum or from specialized rigid support stands.

Conventionally, the support legs often include rubberized feet components which engage upon the distal end of the brackets and serve a number of purposes. A primary purpose is to provide a slip resistant engagement of the supported drum component upon the underlying support surface for the supported drums. This is important since the motion of a drummer impacting the supported drum or component, may often otherwise cause the drums to shift or move during play.

Second, the feet are known to provide a means for resisting or dampening the transmission of the energy of the vibrating drum head through the rigid legs to the floor. Conventionally, this is of particular importance because transmitting the energy to the floor will lessen the vibrations transmitted to adjoining rooms of the building which can cause complaints from irritated occupants. The loss of energy to the floor can also impact the resonation of the drums and other components to the room where they are situated, and a deadening effect occurs. Therefor, the rubber or similar elastically engaging feet provide a balance between support and decoupling the support legs or stand from the floor to minimize the deadening effect.

As noted, conventional support feet for drum instruments are often of a rubber or elastic sheet material formed to elastically engage around the distal ends of support members. So engaged, the elastic rubber type fee act to slightly dampen the vibrations from the legs to the floor and primarily provide a slip resistant support for the drum.

Conventional stretch and fit type feet come in many different shapes but are most commonly known in a rounded tubular shape with a slightly larger surface area at the distal end of the foot, contacting the floor. Often these elastic rubber style feet are formed with an axial passage extending from the uppermost part of the foot from an opening to a fraction of the distance toward the bottom. This allows the user to simply stretch and slip the foot over the typically round shaft of the support legs and elastically engage thereon. Once engaged, as a result the drum or cymbal or similar instrument from the set, is supported a distance slightly above the floor, with a cushion of the stretched rubber material of a thickness equal to the elevated distance, under each support leg.

Such stretch and engage rubber material feet are often called floating feet. For support legs or cymbal or other stands employing legs of different cross section, the axial passage for engaging the foot is instead formed to engage that particular cross section in an elastically contracting or frictional engagement. Such a connection severely reduces and separation provided by the feet as the material from which they are formed is contracted on a cellular scale and conducts sound better to the support surface.

Another known type of drum instrument support feet are called air suspension feet. In this type of support foot a portion of the foot features a hollow air chamber positioned in between the distal end of the support engaged, and the floor. This air chamber acts as somewhat as a suspension which is purported to enhance sustain, tone, depth and resonance of the sound emitted from the drum when it is struck and further minimizing the deadening effect.

However, often such suspension feet conventionally provide little contact surface with the floor and therefore can render the supported drum unstable. Consequently, a balance allowing for a secured slip resistant support to the instrument, and concurrently a decoupling to enhance sound production, and minimize transmission to the building structure, is not effectively met.

Additional downfalls are also present. The synthetic rubber material commonly employed for most ends, conventionally only provides a minimal dampening. Further, the synthetic rubber material itself, especially when stretched to achieve an elastic engagement, will transmit vibration to the floor such that a deadening effect of the communicated vibration and sound for a performance, is still present.

Further, the typical rounded shape of conventional synthetic rubber type feet, and their engagement to the instruments, presents problems to the technician or user who sets up a drum set on a stage. Often during transport and set up of the drum kit to the stage one or more feet will slip off their engagement to respective support legs. Because of their rounded shape in combination with the nature of synthetic rubber material, the feet when they become so disengaged, will tend to bounce around and often roll away from the technician. This can occur more easily when temperatures grow colder causing a shrinking of the metal legs on which the synthetic rubber feet engage faster than that of the engaged feet. When such a disengagement occurs, the round nature of the loose foot and general bouncing nature of the material, will cause a rolling of the loose foot, such that the user much chase it in the venue. This is not only a nuisance but can be quite detrimental to a performance given the strict setup schedules by which musicians must abide.

As a conventional solution to some of the problems noted above, it is known that drummers will place carpets, mats, or other cushioning surfaces on the floor as a means for enhancing the slip resistance characteristics of the feet, as well as enhancing the dampening of the vibrating drum head through the rigid legs to the floor. However, this requires the users to transport and store often very large square footage of carpet or other material and can be of great nuisance.

In addition, similar rubber components are also known to be employed on the drum supporting portion of a conventional snare drum stands as well as the support legs. A typical snare drum stand comprises three upper support arms which are configured to cradle the lower rim of the snare drum. The distal ends of the support arms will often include rubberized components which aid to minimize transmission of the vibrating drum head through the stand and floor, and additionally enhance the grip of the drum to the stand itself. However, these rubber components similarly fail to provide adequate drum support and decoupling characteristics.

As such, there is a continuing unmet need for a support foot device for employment upon the distal ends of supporting brackets for components of drumming equipment and sets which solves many of the above noted problems known in the art. Such a device should be easy to engage, employ, and easy to replace and reconfigure. Such a device should not disengage easily during transport and setup and in the event of an accidental disengagement should be of a material and shape to provide a resistance to bouncing and rolling away from the user. Still further, along with providing a means for dampening the transmission of energy of the vibrating drum head to the floor, such a device should provide a means for reflecting this energy back up in to the drum thereby reducing the loss of energy and thereby improving sound quality.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art of support feet for drum equipment. It achieves the above noted goals through the provision of an engageable foot or support member which is configured of material and in shape, to remain engaged and provides a means for enhanced acoustic decoupling from underlying support surfaces, and means for reflecting the acoustic vibratory energy, back into the drum, to thereby reduce energy loss and enhance the musical sound emitted from the drum or cymbal being supported.

The device is adapted or otherwise configured for removable or retrofit support or engagement to the support brackets at the distal end of a support leg or support stand. So engaged it provides improved means for dampening and resisting transmission of energy from the supported drum or cymbal or set component, to the floor. In some preferred modes, the device additionally employs means for reflecting the energy of the vibrating drum head back into the drum thereby reducing energy loss and further enhancing sound characteristics. The present invention, in various preferred modes, provides means for engagement to a plurality of different type support legs as needed, and in kit or engaged-component form, provides the user with a means for adjusting the decoupling of the engaged device.

It is of particular preference to provide concurrent decoupling to enhance emitted sounds, and minimizing transmission of energy to the building, therefor the body of the device is preferably formed of a polyurethane foam or other material suitable for the intended purpose, such as Ether-Like-Ester (ELE) foam, cross linked polymer, closed cell foam, open cell foam, or the like. Further, a component forming a means for reflecting vibration energy back into the drum and further reducing loss of energy, is preferably provided by the employment of an acoustic reflecting material, coupled with the body portion of the device, such as a rigid plastic, Lexan®, high density polyethylene, or other suitable material one skilled in the art may recognize.

The feet body formed of such material is further preferably shaped or otherwise configured with and exterior configuration which minimizes bouncing or rolling away of a foot if it is dropped from an elevated position. This is of great advantage and preference in the art of musical performance due to the rolling and bouncing problems with the conventional rounded synthetic rubber bodied support feet. In a particularly preferred mode, the feet are of substantially rectangular cross section but may be of any polygonal cross section which prevents or impairs bouncing and rolling.

In the body of the foot or support, in the preferred mode is formed with a polygonal cross section and is of a size to yield feet formed of the noted material which are comparable in size to the conventional support feet known in the art. The device in a preferred mode, includes a passage or cavity communicating axially through an opening or aperture to allow the insertion and frictional engagement of the support leg therein. However, in other retrofit modes the axial cavity of the device may be sized larger than conventional support feet and the cavity or passage may be adapted to engage over the conventional rubber feet already engaged upon the drum or stand. In this mode, the user is then not required to remove the conventional feet that are typically present on an OEM drum kits support legs and which may be permanently affixed.

Additional means for improving acoustics and providing a decoupling of the drum from the ground may be provided through the employment of waffled or serrated contact surface of the device upon surfaces which contact the floor. Such a waffled or otherwise formed surface further minimizes the transmission of vibration through the device to the floor by a minimizing the area of actual contact surface. Concurrently, gaps in the surface provide enhanced frictional engagement to the support surface.

In yet other preferred modes of the device, the formed feet may include means for acoustic decoupling. This may be provided through the inclusion of a water, fluid, or air filled bladder section which is situated in a held position by the body of the device, between the floor and the drum or cymbal in the body of the device.

In at least one preferred mode, the means for reflecting energy back into the drum is provided by a portion of rigid plastic formed of any of the preferred or other suitable materials disposed between an operatively engaged support leg and the body of the support device. As such, the support foot body will effectively decouple the drum from communicating vibrational energy to the supporting floor, while the rigid plastic or other acoustically reflective material will provide a means for reflecting and thereby reducing energy loss thus improving sound quality emission from the drum or cymbal.

Further, in yet another preferred mode, the invention comprises a decoupling component of similar materials which is configured for removable engagement to the support arms of a conventional snare drum stand for acoustically decoupling the snare drum from the stand itself.

Still further, in at least one other preferred the device is providable to the user in kit comprising a plurality of the foot devices. In addition, the kit, or optionally a separate providable kit can comprise a plurality of the snare drum stand arm decoupling components. Thus, for the snare drum in particular the user can employ both the support arm and support leg decoupling components thereby vastly improving the decoupling of the drum from the floor and reducing energy loss from the drum.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the invention to provide an acoustic decoupling device for employment upon drum and drum set instrument support legs or stands.

It is a further object to provide such a device which is configured such that it will not roll or bounce if disengaged.

It is another object to provide an acoustic decoupling device for employment on the support arms of a conventional snare drum stand.

It is another object to provide a means for reflecting the vibrating energy back into the drum through the employment of a acoustic reflecting material employed in the device.

These and other objects, features, and advantages of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 18:
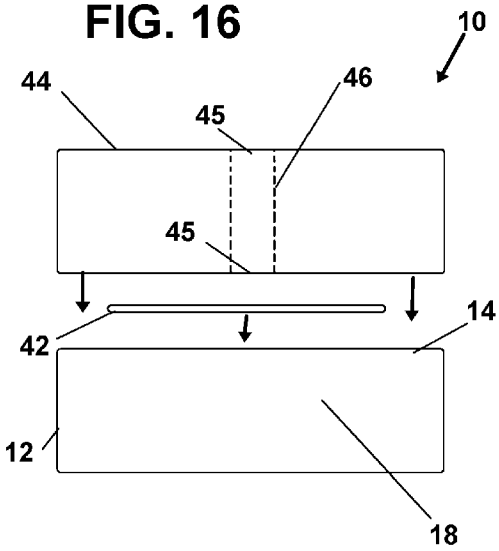
FIG. 18 shows an exploded side view of another preferred mode of the device having a planar plastic disk in a sandwiched engagement between a cushioning cylindrical body of compressible material such as a foam body portion and an upper foam portion, having an axial passage for securely engaging a drum stand support leg.
Figure 18A:
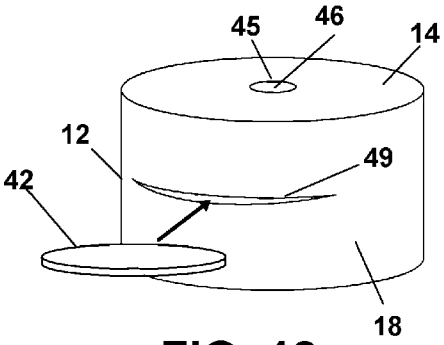

FIG. 18*a* shows another mode comprised of an elongated cylindrical body having a slit communicating from the sidewall of the body to the interior of the body for receiving the planar plastic disk portion.

Figure 19:
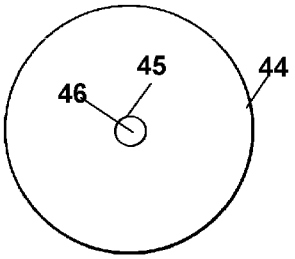

FIG. 19 shows a top view of the upper foam portion depicting the aperture in communicating with the axial passage.

Figure 20:
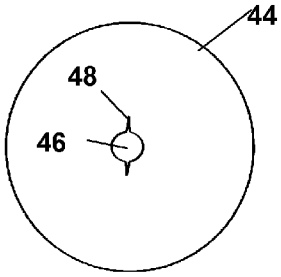

FIG. 20 shows another mode of the axial passage of the upper foam portion employing one or a plurality of relief cuts.

Figure 21:
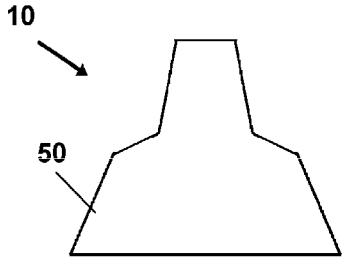

FIG. 21 shows a side view of another preferred mode of the device comprising a flexible outer jacket enclosing a foam cushion portion and acoustically reflective disk portion.

Figure 22:
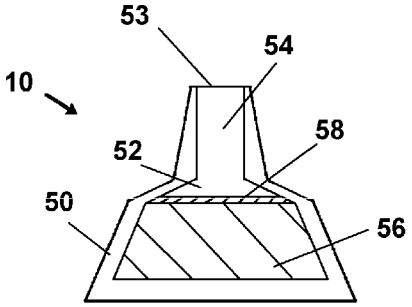

FIG. 22 shows a cross sectional view of the device of FIG. 21 showing an axial passage for engaging the distal end of a support leg communicating with an interior cavity containing the foam cushion portion and the acoustically reflective disk portion.

Figure 23:
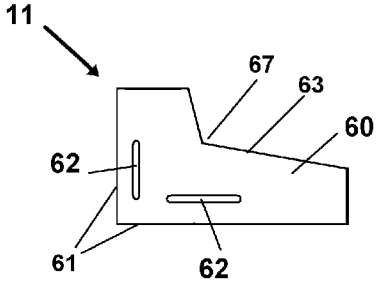

FIG. 23 shows a side view of another preferred mode of the device comprising a substantially L-shaped cushion member adapted for engagement to the distal ends of the conventional support arms of a snare drum stand.

Figure 24:
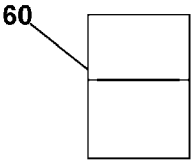

FIG. 24 shows a front view of the device of FIG. 23.

Figure 25:
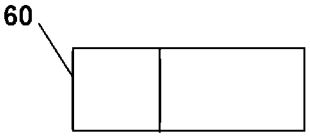

FIG. 25 shows a top view of the device of FIG. 23.

Figure 26:
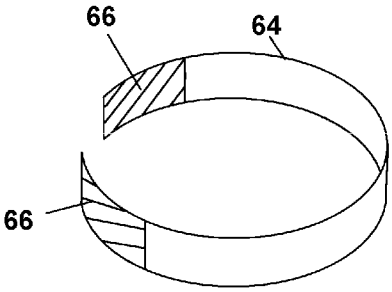

FIG. 26 shows a view of an engagement band having hook and loop fasteners at the ends which employed as a means for engaging the device of FIG. 23 to the support arms of a snare drum stand.

Figure 27:
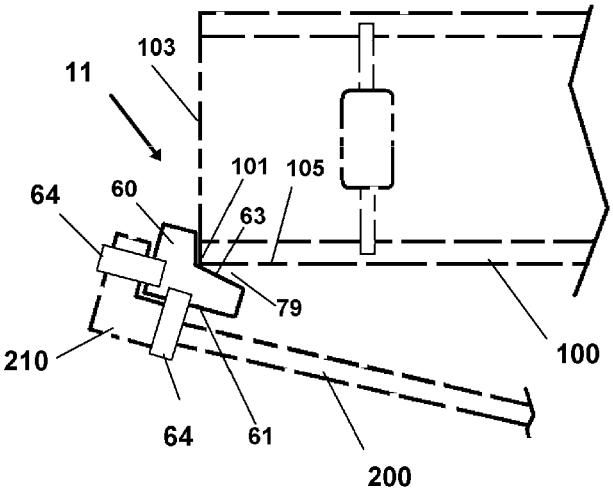

FIG. 27 shows a preferred as used mode of the device of FIG. 23 with a drum situated in an as-used position with the body engaged to a distal end of the support arm for the drum.

Figure 28:
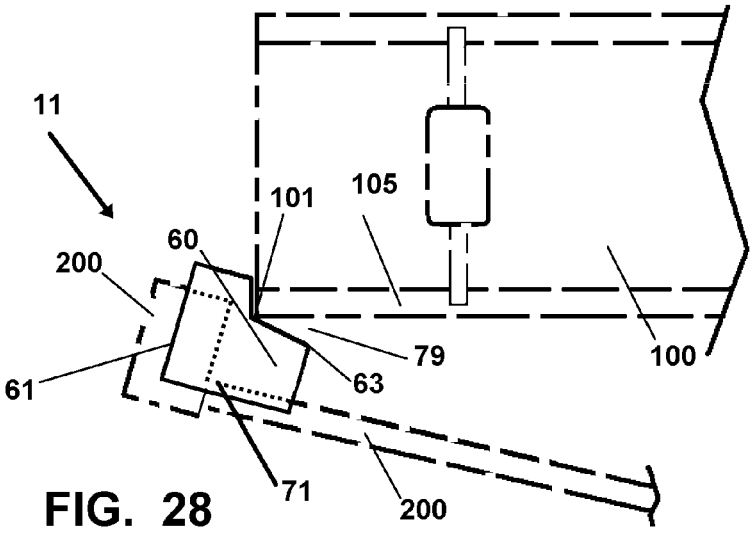

FIG. 28 depict another mode of the device of FIG. 27 employing a recess as a fastener for the body to the surface of the support arm.

Figure 29:
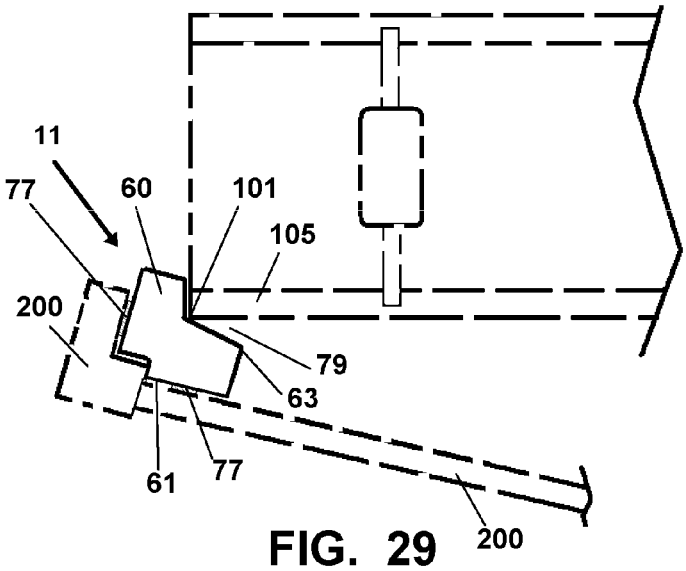

FIG. 29 depicts a mode of the device of FIG. 27 or 28 wherein adhesive or a magnet is employed as a fastener for the body to the support arm.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
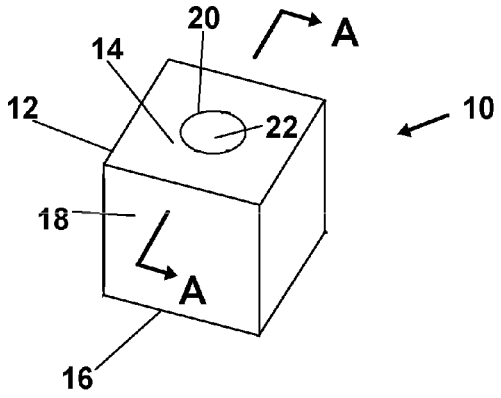
FIG. 1 shows an elevated view of a preferred mode of the acoustic decoupling device formed of a substantially rectangular cross section support member and having a formed passage or cavity therein.
Figure 2:
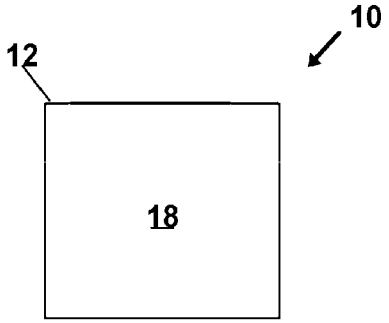
FIG. 2 shows a side view of FIG. 1.

Now referring to drawings in FIGS. 1-29, wherein similar components are identified by like reference numerals, there is seen in FIG. 1 and FIG. 2 elevated and side views respectively of a particularly preferred mode of the device 10 having a body 12 formed substantially in the configuration of a cube or cylinder or other shape shown in the drawings. In all modes of the device 10 herein, the body 12 of the device 10 is preferably formed of a resilient material, which is compressible under a force and rebounds as the force is lessened and exerts a bias while force is applied, opposite the force direction.

Any resilient material which will compress slightly under the weight of the supported drum or cymbal, and continuously exert a biasing force in the direction of the leg, and which will acoustically isolate the instrument from the floor or support surface is employable. Currently, the resilient material which has shown to work exceptionally well in experiments, is formed of foam-like materials including one or a combination of foam materials from a group including polyurethane foam, Ether-Like-Ester (ELE) foam, closed cell foam, and open cell foam, or the like, and having an average durometer of such materials. This material has been shown in experimentation to yield enhanced decoupling from support surfaces for enhanced sound from the instruments over the synthetic rubber material of conventional feet which is of a much harder durometer.

The body 12 includes generally a top wall 14, bottom wall 16, and a continuous or a plurality of sidewalls 18 communicating therebetween. When formed with a plurality of sidewalls of differing but intersecting planes, the current favored number of the plurality of sidewalls is four. Four sidewalls formed of intersecting planar portions, have shown to minimize roll and bouncing upon a disengagement, especially from an elevated height.

On the top wall 14 there is depicted an aperture 20 providing a communication into an axial passage or otherwise formed cavity 22 for the support legs or members. In use, a drum support leg, support stand leg (not show), or the like, is engaged within the cavity 22 such as by inserting the distal end of the support leg (not shown) through the aperture 20 and into a frictional engagement with the sidewall defining the cavity 22.

In this and other modes of the device 10 described herein it is preferred that the body of the device 10 be formed with multiple intersecting planar sidewalls, to provide a means for reducing the chance of sequential bouncing and/or rolling away in the case of an elevated drop. Although the current preferred mode accomplishes this by providing a body 12 of polygonal cross section, those skilled in the art may realize other means for achieving the above noted goal and are anticipated.

Figure 3:
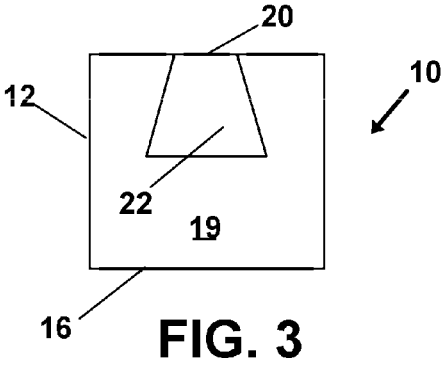
FIG. 3 shows a cross sectional view of the device of FIG. 1 along line A-A showing a preferred conical cross section of the cavity or passage.

FIG. 3 shows a cross sectional view of the device 10 of FIG. 1 detailing one preferred mode of configuration of the cavity 22. As can be seen, the cavity 22 extends from the aperture 20 down a portion of the total distance of the overall length of the body 12 of the device 10. As such, a buffer or cushion zone 19 is formed and maintained by the foam portion of the body extending from the bottom of the cavity 22 to the bottom wall 16 of the body 12. This buffer zone 22 provides a means for vibration dampening and a decoupling of the drum leg (when engaged) from the supporting surface such as a floor and a reducing of the deadening effect to the emitted sounds as noted above.

One current preferred cavity 22 is shown as having a substantially frustoconical shape. This configuration is especially well adapted to receive the exterior of conventional frustoconical rubber feet typically present on drum support legs. As such, in this mode the user is not required to remove the OEM synthetic rubber feet from the drum support legs in order to employ the device 10.

Figure 4:
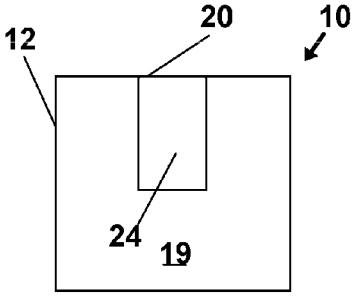
FIG. 4 shows a cross sectional view of the device of FIG. 1 along line A-A of FIG. 1 showing another preferred cross section of the cavity or passage being substantially cylindrical.

FIG. 4 shows a cross sectional view of yet another preferred mode of the invention showing a substantially cylindrical cavity 24. This mode is especially well adapted to receive the uncovered distal end of a round member or bar support such as when the conventional hard synthetic rubber support feet, or formed of a material with a similar harder durometer, are removed. This mode may be desired to reduce the overall weight of the drum by removal of the heavy rubber feet as well as for other reasons.

It must be noted that the cavity 22 of the body 12 of the device 10 may be of a cross section other that those shown in the figures in order to properly engaged various other conventional feet and support leg shapes and designs known in the art as is the intent of the invention. As such those skilled in the art will realize that the depictions shown are given merely for descriptive reasons to portray the overall intent and scope of the device and should therefor not be considered limiting.

Figure 5:
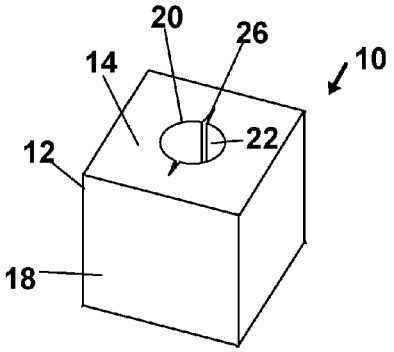
FIG. 5 shows another preferred mode of the device employing relieve cuts to allow easy insertion of a support leg into the cavity.

FIG. 5 shows yet another particularly preferred mode of the device 10 where the aperture 20 and cavity 22 employ relief cuts or slits 26 in the wall surface, to aid the user to more easily insert and engaged a support leg or foot therein. In the mode shown the slits 26 extend from the top end or top wall 14 surrounding the aperture, to the bottom of the cavity 22. However, in other modes, the slits 26 may only extend a fraction of the depth of the cavity 22 as needed. Further, it must be noted that the provision of relief slits 26 may be employed in combination with any of the preferred modes of the invention. The relief in the wall surface of the cavity 22 reduces contact with the inserted end of a stand leg or support therein, while still yielding the elevated support above the support surface or floor. This lessening of contact provides enhanced decoupling and resulting enhanced sound from the supported drum or instrument.

Figure 6:
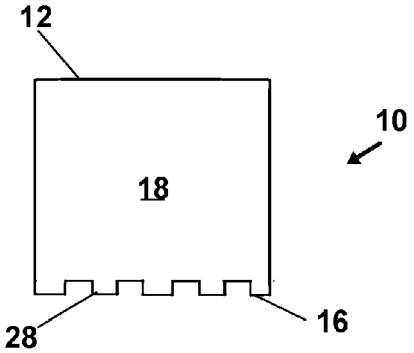
FIG. 6 is a side view of yet another preferred mode of the device employed a waffled or serrated bottom surface.

Still yet anther preferred mode of the device 10 is shown in the side view of FIG. 6. In this mode which may be employed in combination with all other modes of the device herein, the bottom wall 16 which provides the contact surface area with the floor, has similar reliefs formed therein to yield a substantially waffle pattern bottom 28. The waffle bottom 28 provides a means for reducing the contact surface area of the bottom wall 16 of the device, with the floor which further provides a means for acoustically decoupling the drums from the floor and reduce transmission of vibration. This mode may also be employed separately or in combination with the other modes of the device 10.

Figure 7:
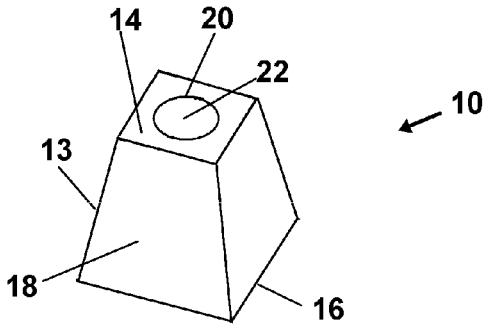
FIG. 7 is an elevated view of still yet another preferred mode of the device being formed of a tapering rectangular cross section.

FIG. 7 shows still another preferred mode of the device 10 having a tapering rectangular body 13. As shown, the body 13 tapers from a larger surface area at the bottom wall 16 to a smaller surface area at the top wall 14. This mode additionally includes an aperture 20 and cavity 22 extending therefrom. This mode may be preferred due to the weight reduction incurred by the tapering body 13 compared to that of FIG. 1.

Figure 8:
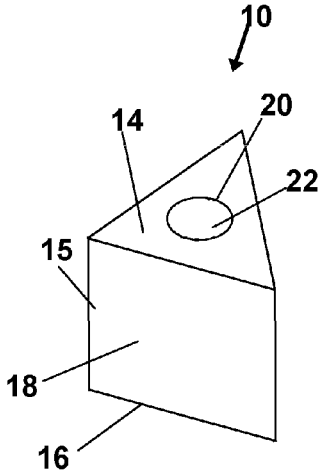
FIG. 8 shows yet another preferred mode of the device formed in a triangular cross section.

FIG. 8 shows yet another preferred mode wherein the body 15 of the device 10 is of a substantially triangular cross section. Again it is noted that the device 10 may be of other cross sections as needed to provide a means for reducing the risk of bouncing or rolling as is noted above. Although not shown the device 10 having a triangular cross section body 15 may tapered as was shown in FIG. 7.

Figure 9:
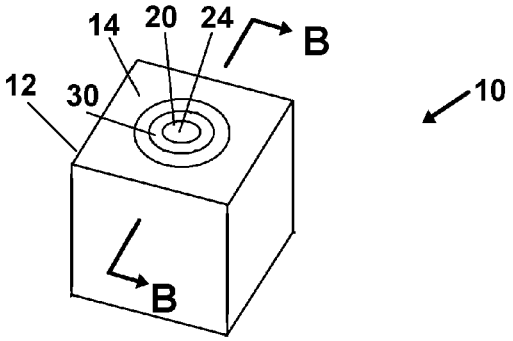
FIG. 9 is another preferred mode of the device employing concentrically engaged removable cylindrical inserts providing a means for adjusting the diameter of the cavity.
Figure 10:
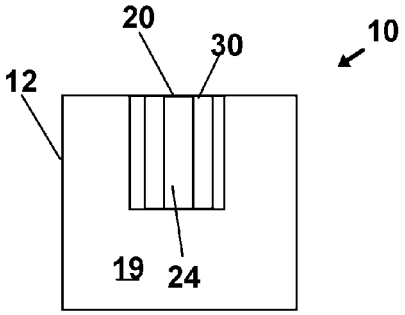
FIG. 10 is a cross sectional view of the device of FIG. 9 along line B-B of FIG. 9 showing a first cavity diameter.
Figure 11:
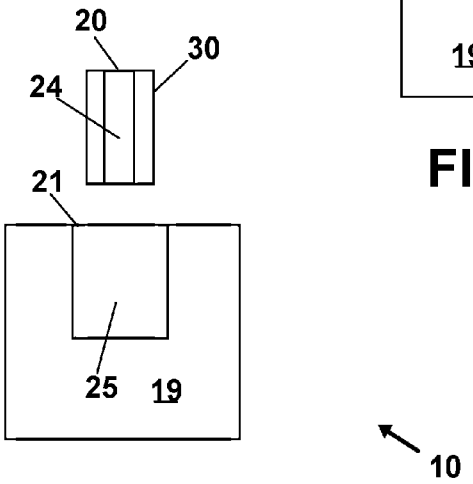
FIG. 11 shows a cross sectional view of the device of FIG. 9 along line B-B of FIG. 9 showing a second diameter achieved by removing the cylindrical insert.

It is known that drum support legs may vary in diameter from drum to drum and as such there is shown in FIG. 9 a preferred means for varying the size of the aperture 20 and cavity 24 of the body 12 of the device 10. In this mode the device 10 employs one or a plurality of removably engageable coaxially aligned and concentrically engaged cylindrical components 30. As shown in the cross section view of FIG. 10, showing a single cylindrical component 30 in the engaged position, a first diameter aperture 20 communicating with a first diameter cavity 24 is provided. This aperture 20 and cavity 24 may be sized to receive a first diameter of support legs known in the art. Further, shown in FIG. 11, upon removal of the cylindrical component 30, there is then provided a second larger aperture 21 communicating with a second larger cavity 25. This larger cavity and aperture 25, 21 may be adapted to engage larger sized support legs known in the art.

Figure 12:
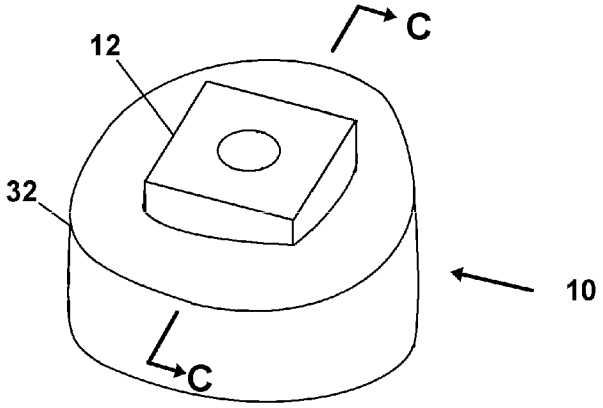
FIG. 12 shows yet another preferred mode of the device employing a fluid filled bladder engaged around the body of the support member.
Figure 13:
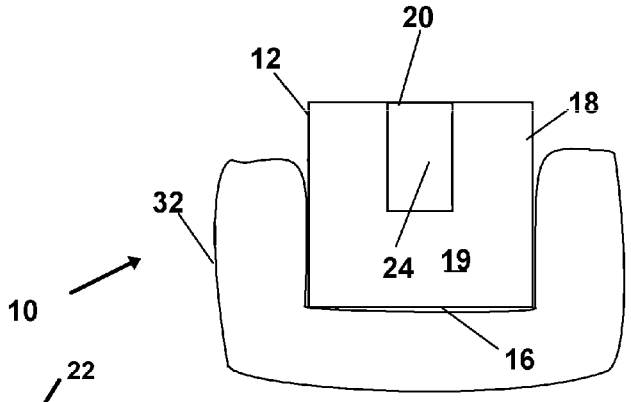
FIG. 13 shows a cross sectional view of the device of FIG. 12 along line C-C of FIG. 12.

Still further, additional means for acoustic decoupling and reduction of vibration transmission to the floor is shown in FIGS. 12 and 13 which employ a fluid-filled bladder 32 portion of the body. The bladder 32 may be filled with fluid such as water, air, or other fluid and is intended to engaged about the bottom and sidewalls 16, 18 of the body 12 of the device 10. However, in other modes, the bladder 32 may be formed unitarily with the body 12.

It must be noted that although the bladder 32 is shown employed in combination with the mode of the device of FIG. 1 it may be employed with any of the modes of the device 10 disclosed previously. The bladder 32 provides a further cushion or buffer between the support leg of a drum and the floor when engaged within the cavity 24. As such the bladder 32 provides a means for substantially reducing the transmission of vibration and further decouples the drum from the floor again substantially reducing the deadening effected noted previously.

Figure 14:
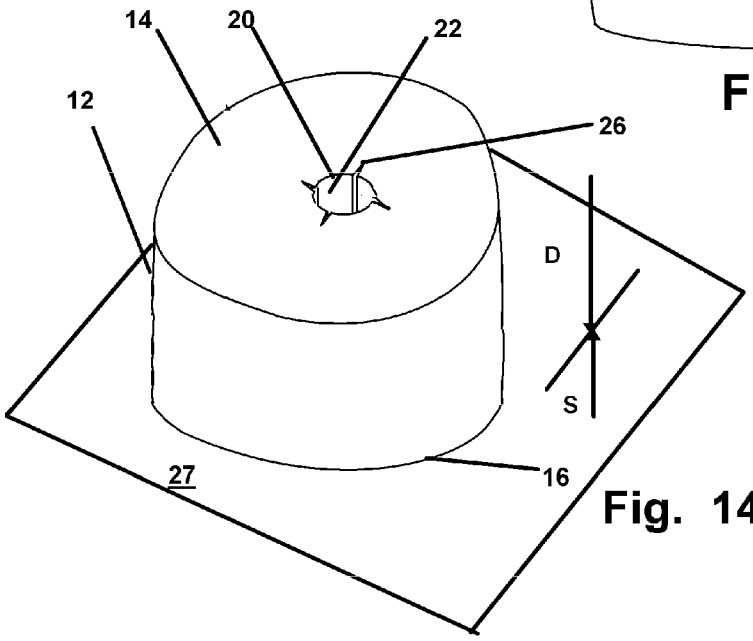
FIG. 14 shows yet another particularly preferred mode of the device having a cylindrical body and an axial cavity with relief slits.

FIG. 14 shows yet another particularly preferred mode of the device 10 having a cylindrical body 12 and further includes an aperture 20 communicating with an axial positioned cavity 22 which as relief cuts or slits 26 in the wall surface communicating with the aperture 20. The cuts descend a distance "D" into the body 12 as does the cavity 22 which is not the complete length of the body 12 but between one half to two thirds of the entire distance between the top wall 14 and bottom wall 16 which communicates with the support surface.

This, less than total communication, defines a distance "D" for a spacing portion of the body 12 which communicates between the distal end of a supporting leg or member for the drum or cymbal, and the support surface or floor 27. This spacing portion provides a means for elevating the supporting leg above the floor and concurrently support it with the material forming the body 12 in the spacing portion. As noted earlier, relief slits 26 may be employed in combination with any of the preferred modes of the invention and provide both a means for easy accommodating of the diameter of the aperture 20 to the circumference of the supporting leg or member, as well as a concurrent reduced contact with the inserted end of a stand leg or support member inserted into the cavity 22. This lessening of contact provides enhanced decoupling of the instrument from the support surface or floor 27 and resulting enhanced sound from the supported drum, cymbal or instrument.

Figure 15:
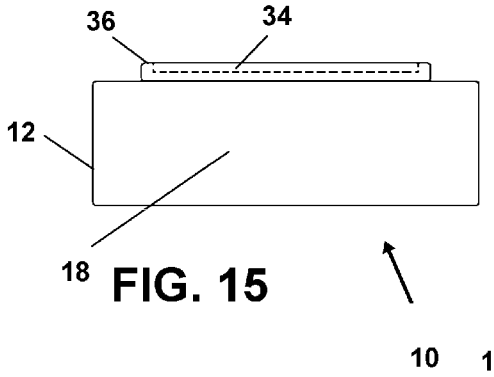
FIG. 15 shows a side view of another particularly preferred mode of the device having a cylindrical body of compressible material which biases outward when compressed, and an a planar acoustically reflective plastic disk having an annular raised lip engaged to the top wall of the body.
Figure 16:
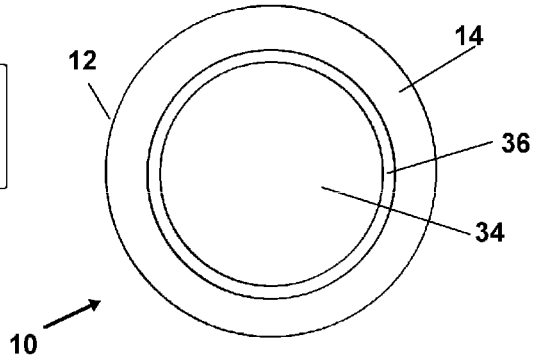
FIG. 16 shows a top view of the mode of the device of FIG. 15.

FIGS. 15 and 16 and 18 show views of yet another particularly preferred mode of the device 10, comprising a substantially cylindrical cushion body 12, preferably formed of one or a combination of compressible material. Such compressible material particularly preferred is foam materials from a group including cross linked polyethylene foam, polyurethane foam, Ether-Like-Ester (ELE) foam, closed cell foam, pvc foam, polyester foam, open cell foam, closed cell foam, sponge, or other suitable material in the range of 25-90 Shore on an OO scale. In a particularly preferred mode, a cross linked polyethylene foam having a hardness in the range of 30-60 Shore A, has been shown to work exceptionally well in decoupling the drum from communicating vibration into the underlying support surface. However it is noted that other materials of the desired hardness range may also be employed and are anticipated. Further, materials having a shore hardness outside the specified range, which are determined to be suitable for the intended purpose, may be employed and are also anticipated.

As shown in this particularly preferred mode of the device 10, means for reflecting the energy of the vibrating drum head communicated to the support legs back toward the drum body is provided by a planar rigid disk member 34 positioned on the top surface 14 of the body 12 of the device 10 if a single piece body is employed. The disk member 34 is preferably formed from an acoustically reflective material such as a rigid plastic material including LEXAN in a thickness between 0.03 inches and 0.5 inches with the thinner end of that thickness scale preferred. Also, high density polyethylene, polypropylene, or PVC sheeting in similar thicknesses, or other rigid material suitable for reflecting vibrational energy back up the support leg, one skilled in the art may recognize. It is additionally noted that the disk portion 34 can be of any shape and is therefor not limited to the circular disk shape as shown. For example, the disk portion 34 can be square, rectangular, polygonal, or essentially any shape suitable for the intended purpose as can the body 12 or other components. However, it is preferable to have the disk portion 34 with a smaller circumference than the foam material supporting it for ease of mounting and changing the material is desired.

The mode of the device 10 shown in FIG. 18, has been shown to work well and employs a harder or stiffer foam material in a lower portion 31 of the body 12, than that of an upper portion 33. The upper portion 33 formed of open cell foam material will have the aperture and axial passage 46 configured to frictionally engage the circumference of a supporting drum leg, which sits upon the planar disk portion 34. The planar disk portion 34 is supported in its elevated position spaced from the support surface such as the floor, by the lower portion 31 of the body 12 which is formed of closed cell material, which should have a shore which is slightly harder than that of the upper portion 33 which is provided to prevent lateral translation of the leg from the device.

The lower portion 31 and upper portion 33 may have perimeters which are larger than that of the planar disk portion 34 to allow the upper surface of the lower portion 31 to be adhered to the lower surface of the upper portion 33 surrounding the perimeter of the planar disk portion 34. This allows the planar disk portion 34 to be supported upon the lower portion 31 and held in place by the adhered surrounding engagement of the upper portion 33 to the lower portion 31 but with only a supported attachment to the lower portion 31 without adhesive or the like. This supported but unadhered attachment of the planar disk 42 has shown to reflect vibration back toward the drum generating it, yielding enhanced performance.

In use the conventional foot of the support leg of a drum is placed in a supported position on the planar disk portion 34 or 42 of the device 10. As the drum head is struck, the vibrational energy travels through the drum and down the support leg to the foot wherein the foam body 12 provide a means for acoustic decoupling of the support leg from support surface or floor.

Further, the planar disk portion 34 or 42, provides a rigid platform for the drum atop the separating supporting foam and passes some energy to the foam body 12 as a means for dampening while it's rigid structure additionally provides a means for reflecting most of, or a substantial amount of the drum generated energy, back up the leg and to the drum thereby improving sound qualities and projection of the engaged drum. The disk 34 when employed without the upper portion of the body, preferably includes a raised sidewall or lip 36 extending around its peripheral edge as a means for preventing the conventional foot from slipping off.

Figure 17:
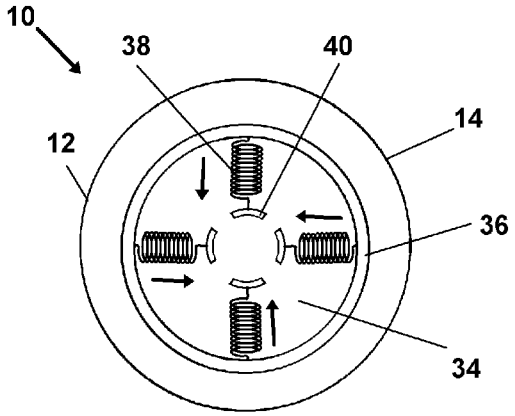
FIG. 17 shows a top view of another mode of the device similar to the mode of FIG. 15 however employing a plurality of biasing engagement members adapted for securely engaging a drum stand support leg thereon.

FIG. 17 shows another mode of the device 10 similar to the mode of FIGS. 16 and 17 however employing a plurality of biased engagement members 40 as a means for securely engaging the foot of a support leg to the device 10. In the current mode shown, the engagement members 40 may be inwardly spring biased 38 which will compressively bias a support leg foot positioned centrally on the disk 34.

FIG. 18 shows another particularly preferred mode of the device 10 which has shown particular promise in experimentation in increasing sound emitted from the decoupled drums. As shown, the device is formed in two components of a cushioning body 12 portion which supports an overhead upper portion of an upper engagement member 44. An axial passage 44 provides means for secured and a biased engagement of the foot of a drum support leg to which it is adapted in size for operative engagement.

In this two part mode of the device, the upper engagement member 44 portion is shown substantially cylindrical in shape and having the axial passage 46 communicating between opposing apertures 45 at opposite ends of the passage 46 disposed on the top and bottom surfaces of the upper engagement member 44.

Particularly preferred in this mode of the device 10 is the inclusion of a planar disk portion 42 adjacent the aperture 45 on the lower side of the engagement member 44. The planar disk portion 42 is in a sandwiched engagement between the top surface 14 of the foam cushioning body 12 and the upper engagement member 44 which the cushioning body 12 supports in an elevated position along with the planar disk portion 42. Means for engagement of the cushioning body 12 to the supported engagement member 44 can be adhesive, hook and loop fasteners, heat fusion, fasteners through both components, or any other suitable means. For example the top surface 14 of the body 12 can have an adhesive layer for engaging both the disk member 42 and upper member 44 thereon if the circumference of the disk member 42 is smaller than the respective circumferences of the upper member 44 and the body 12. This allows for adhesion of the upper member 44 to the top of the body 12 and the perimeter of adhesion between the two holds the disk member 42 in a central position sandwiched therebetween.

FIG. 18*a* shows yet another mode of the device 10 having an elongated unitary solid cylindrical body 12 having a substantially central axial passage 46 communicating from an aperture 45 on the top surface 14 of the body 12 a distance into the body. A slit 49 is provided communicating from the sidewall 18 of the body 12 to at least the distance to a central portion of the interior of the body 12. The slit 49 is configured to receive a rigid planar disk portion 42 such that the disk 42 can be positioned within the body 12 in an axial alignment with the body 12. As such the passage 46 preferably extends into the body 12 at least the distance of the location of the slit 49. This unitary structure mode of the device may have two differing types of foam or plastic forming the body 12 and the upper member 44 which are formed in the same mold and allowed to fuse together, or it can be formed of a single type of foam or rubber or other polymeric or plastic materials.

FIGS. 19 and 20 show top views depicting the aperture 45 communicating with the axial passage 46. In FIG. 20 one or a plurality of relief cuts 48 can be provided such as those shown previously in FIG. 14.

FIGS. 21 and 22 shows a view of yet another particularly preferred mode of the device 10 comprising a flexible outer housing portion 50 having a distal aperture 53 communicating with an axial passage 54 extending to a interior cavity 52. The housing 50 can be formed from rubber or other suitable material, such as the conventional rubber employed for the feet of drum support legs. As can be seen, the housing 50 comprises an interior cavity 52 containing a layer of foam cushion material 56, such as cross linked polyethylene or other suitable material, and a top layer being a rigid layer 58 providing means for reflecting energy back into the drum. In use the axial passage 54 is adapted to engaged the distal end of a drum support leg (not shown) either as a retrofit or an OEM support leg foot. As such, the current preferred mode provides a easy to use and engage unitary structure which achieves the goals of the modes of the device 10 shown in FIGS. 15-20.

FIGS. 23-29 depict yet another particularly preferred mode of the invention providing an acoustically decoupling and vibrational dampening device 11 which is adapted for engagement to the support arms 200 of a conventional snare drum 100 stand but which could also be employed with any stands supporting other elevated drum types.

As shown, the device of FIGS. 23-27 is formed of a substantially L-shaped body 60 formed of a member of the preferred foam materials described previously which provide for a vibration dampening and acoustic decoupling of the drum 100 from the underlying support elevating it from the floor or support surface. The L-shaped body 60 in all modes in FIGS. 23-29 is shown configured for a removable engagement of a first side 61 to or upon the support arm 200 for an elevated drum such as a snare drum 100 shown. However, OEM support arms 200 might also be provided with some type of permanent engagement for the L-shaped body 60. In either such configuration the second side 63 is configured with a first and second section intersecting at an angle 67 such that the circumferential edge 101 of an engaged drum 100 contacts the body 60, but that a lower surface 105 of the drum 100 is substantially out of any contact with the body 60 as shown in FIGS. 27-29.

This engagement using the angled intersection of first and second sections of the second side surface 63 extending from an intersection point thereon, has been found to yield additional decoupling and enhanced performance from a body 60 having a substantially perpendicular angle at the intersecting first and second sections of the second side surface 63. Consequently, while a perpendicular intersection of the first and second sections of the second side surface 63 will work, the angle 67 at the intersecting point which causes a section of the second side surface 63 to descend and avoid contact with the supported drum 100 is preferred in all modes of the device of FIGS. 23-29.

The engagement of the body 60 to the support arms 200 employs in all modes, a fastener to engage the first side 61 of the body 60 to or against the support arms 200. In one depicted mode, the fastener is provided by engagement straps 64 which attach at one position to the body 60 and are configured with opposing ends of the strap 64 with each have half of a separable fastener.

The strap 64 is attached to the body 60 in a fashion to hold it secure to the support arms such as employing one or a plurality of apertures defining slits 62 communicating between opposing sidewalls of the body 60. The size of the slits 62 is configured to allow passage of the strap 64 shown in FIG. 26, through the body 60. On each opposing end of the straps 64 is one half of a separable fastener which as shown include fastener ends 66, having one half portion of a hook and loop fastener. However, other separable fasteners, where one half is positioned on each end of the strap 64, can be employed such as snaps, clips, buttons, pins, sewing, or other separable fasteners as would occur to one skilled in the art.

In another mode, such as in FIG. 28, a fastener for engagement of the body 60 to the support for the drum 100 can be a recess 71 formed into the first side 61 of the body 60 which is complimentary in shape to an engaged portion of the support arm 200 such that the body 60 slidably engages upon the support arm 200 and is supported therein within the recess 71. The recess 71 may be formed in a shape complimentary to the shape of the sections of the drum support arm 200 to which it engages and works especially well if equal in size or forming a recess 71 slightly smaller than the exterior of the support arm 200 to achieve a biased engagement thereon by compression of the material forming the body 60.

Yet another mode to engage the body 60 in operative engagement between the drum 100 and the supporting stand elevating it, such as the support arm 200 would be engagement points 77 for adhesive or magnetic engagement of the first side 61 to or against the support arm 200. As with all modes, where the body 60 is positioned to contact the drum 100, the angled positioning of the first and second sections of the second side surface 63 of the body relative to each other is maintained such that the circumferential edge engages the body 60 and the edge portion positioned underneath the drum 100 in this as-used positioning of the drum 100, angles away from the lower surface of the drum 100 and whereby the drum 100 in this as-used positioning is supported by the lower circumferential edge 101 in contact with the second side surface 63 while the remainder of the lower surface of the drum 100 is spaced from the second side surface 63 by a gap 79 therebetween. Currently, an angle between 95-185 degrees is preferable, with an angle of 120-140 degrees being especially preferred as experimentation has shown such to work with a large segment of the different characteristics of geometry of differing manufacturer's drums and allow for a contact with the side surface thereof, and the lower circumferential edge 101 while maintaining the gap 79 therebetween which has shown to enhance decoupling.

This invention has other applications, potentially, and one skilled in the art could discover these. The explication of the features of this invention does not limit the claims of this application; other applications developed by those skilled in the art will be included in this invention.

Thus, upon reading this disclosure, those skilled in the art may recognize various other means for acoustic decoupling, vibration dampening, and vibrational energy reflecting, which are considerably or slightly different those disclosed, are considered within the scope and intent of the invention herein, and are anticipated withing the scope of this patent.

It is additionally noted and anticipated that although the device is shown in its most simple form, various components and aspects of the device may be differently shaped or slightly modified when forming the invention herein. As such, those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. An apparatus for maintaining a drum acoustically separated from an underlying support, comprising:

a body having a first side adapted for engagement upon a supporting surface of a support for a bottom side of said drum;

said body having a second side opposite said first side configured for a contact upon a circumferential edge of said bottom side of said drum positioned thereon in an as-used positioning of said drum, elevated above said supporting surface of said support;

said second side having a first section and a second section intersecting at an angle;

said first section in communication with said circumferential edge at or adjacent an intersection between said first section and said second section;

a gap formed between said second section of said second side and said bottom side of said drum in said as-used positioning; and said gap increasing in size from a minimum distance adjacent said intersection to a maximum distance adjacent a distal end of said second section opposite said intersection;

said body formed of compressible material, said compressible material being resilient.; and whereby communication of vibration from said drum to said support is prevented by said body positioned in-between said circumferential edge and said supporting surface, thereby increasing sound resonating from said drum caused by said vibration.

2. The apparatus for maintaining a drum acoustically separated from an underlying support of claim 1, additionally comprising:

a fastener for maintaining said first side in said engagement upon said supporting surface of said support.

3. The apparatus for maintaining a drum acoustically separated from an underlying support of claim 2 wherein said angle is between 120 to 140 degrees.

4. The apparatus for maintaining a drum acoustically separated from an underlying support of claim 3 wherein said fastener comprises:

a flexible strap having two ends engaged with said body; and each of said two ends having a respective half of a separable fastener thereon.

5. The apparatus for maintaining a drum acoustically separated from an underlying support of claim 3 wherein said fastener comprises:

a recess formed into said first side of said body; and said recess being configured complimentary to a shape of said surface of said support whereby said support is positionable within said recess.

6. The apparatus for maintaining a drum acoustically separated from an underlying support of claim 3 wherein said fastener comprises:

said fastener being one of adhesive or a magnet.

7. The apparatus for maintaining a drum acoustically separated from an underlying support of claim 2 wherein said fastener comprises:

a flexible strap having two ends engaged with said body; and each of said two ends having a respective half of a separable fastener thereon.

8. The apparatus for maintaining a drum acoustically separated from an underlying support of claim 2 wherein said fastener comprises:

a recess formed into said first side of said body; and said recess being configured complimentary to a shape of said surface of said support whereby said support is positionable within said recess.

9. The apparatus for maintaining a drum acoustically separated from an underlying support of claim 2 wherein said fastener comprises:

said fastener being one of adhesive or a magnet.

10. The apparatus for maintaining a drum acoustically separated from an underlying support of claim 1 wherein said angle is between 95 to 185 degrees.

11. The apparatus for maintaining a drum acoustically separated from an underlying support of claim 10 wherein said fastener comprises:

a recess formed into said first side of said body; and said recess being configured complimentary to a shape of said surface of said support whereby said support is positionable within said recess.

12. The apparatus for maintaining a drum acoustically separated from an underlying support of claim 10 wherein said fastener comprises:

said fastener being one of adhesive or a magnet.

* * * * *